US010758803B2

(12) United States Patent
Morse

(10) Patent No.: US 10,758,803 B2
(45) Date of Patent: Sep. 1, 2020

(54) PORTABLE GYM STRUCTURE

(71) Applicant: Marvin Brent Morse, Richmond, VA (US)

(72) Inventor: Marvin Brent Morse, Richmond, VA (US)

( * ) Notice: Subject to any disclaimer, the term of this patent is extended or adjusted under 35 U.S.C. 154(b) by 101 days.

(21) Appl. No.: 15/897,644

(22) Filed: Feb. 15, 2018

(65) Prior Publication Data

US 2018/0229094 A1 Aug. 16, 2018

Related U.S. Application Data

(60) Provisional application No. 62/459,882, filed on Feb. 16, 2017.

(51) Int. Cl.

| | |
|---|---|
| ***A63B 69/00*** | (2006.01) |
| *A63B 9/00* | (2006.01) |
| *A63B 71/02* | (2006.01) |

(52) U.S. Cl.

CPC .... *A63B 69/0048* (2013.01); *A63B 2009/006* (2013.01); *A63B 2071/024* (2013.01); *A63B 2208/12* (2013.01); *A63B 2210/50* (2013.01); *A63B 2225/09* (2013.01)

(58) Field of Classification Search

CPC ..... A63B 2071/024; A63B 2208/12; A63B 2225/09; A63B 2210/50; A63B 69/0048; A63B 2009/006

See application file for complete search history.

(56) References Cited

U.S. PATENT DOCUMENTS

| | | | | |
|---|---|---|---|---|
| 5,941,041 | A * | 8/1999 | Robinson | A63B 9/00 472/116 |
| 9,427,647 | B2 * | 8/2016 | Moy | A63B 69/0048 |
| 2018/0140922 | A1 * | 5/2018 | Greer | A63B 21/1636 |
| 2019/0299076 | A1 * | 10/2019 | Harrity | A63B 21/16 |

FOREIGN PATENT DOCUMENTS

| | | | | |
|---|---|---|---|---|
| DE | 4342054 | C1 * | 3/1995 | A63B 69/0048 |

OTHER PUBLICATIONS

Translation of DE 4342054, 1995.*

* cited by examiner

*Primary Examiner* — Megan Anderson

(74) *Attorney, Agent, or Firm* — Venjuris, P.C.

(57) ABSTRACT

A portable gym structure that is light weight and allows variable arrangement is disclosed. The portable gym structure is comprised of climbing walls and feet anchors for stability. The portable gym structure has variable configurations for different ages and abilities. The portable gym structure includes climbing walls that can be used for a slide or can be interchanged to be a climbing wall with variable climbing pieces.

19 Claims, 7 Drawing Sheets

PORTABLE GYM STRUCTURE

This application claims the benefit of U.S. Provisional Application No. 62/459,882, filed Feb. 16, 2017 and entitled Jam's Gym, which is incorporated by reference herein in its entirety.

The present invention is directed to a portable climbing wall structure. Specifically, the structure is designed in such a way that it is adapted for easy assembly and disassembly and is portable in nature.

FIELD OF THE INVENTION

The present invention relates generally to a portable gym structure that can be used by a variety of individuals in multiple configurations. The portable gym structure of the present invention has a unique configuration that allows for portability and variable configuration.

BACKGROUND OF THE INVENTION

Playground and climbing structures are widely installed and enjoyed by millions of people around the world on a daily basis. These types of structures are used by small children and adults alike. While the safety and structural integrity of these various structures has improved greatly over the years, many of these structures are used outdoors and are permanently fixed in the ground or onto a surface until they inevitably wear out from use and the outdoor elements. Additionally, existing structures have a fixed height and no variability with respect to the basic construction of the structures. Moreover, once constructed, existing structures are relatively difficult to disassemble and move or store.

Similarly, infant and toddler structures are often conceptually similar to the above described playground and climbing structures, but typically are relatively small scale and afford a light-duty construction. These types of structures are usually not permanently fixed and have very limited variety. Because of the limited variability of the structures for infants or toddlers, there is restricted stimulation causing the existing structures to lose their appeal and quickly become unused. Additionally, the relatively small scale and light duty construction render existing structures too small in size to appeal to older toddlers and children.

As can be seen from above, there are no playground or climbing structures for any age individuals that are portable, flexible in design, and offer variety, including appropriate sizing, to the users. Thus, a need exists for a playground and/or climbing structure that offers safety, portability, and variety of design and size to its users.

Therefore, the currently disclosed portable gym was created to provide a device that allows safety, portability, variety, and cost effectiveness. This device improves the prior art in performance and safety. Considering the various portable gyms and playground equipment on the market and those as found in various patents and patent publications, none of these devices provide all of the elements which result in the durability, functionality, and performance found in the present invention.

The present invention includes a new and improved apparatus for use as a portable gym structure. This structure can be used by any age and size of individual as it has variable configurability and sizing.

SUMMARY OF THE INVENTION

The present invention is directed to a portable gym structure for indoor or outdoor use.

The portable gym structure of the present invention comprises first and second climbing walls. Each climbing wall comprises a top end and a base end where the top end is substantially parallel to the base end. The climbing walls are coupled such that the climbing walls are movable with respect to each other and an angle defined by side edges of the climbing walls is variable with the movement of the climbing walls in relation to each other. The top ends of the climbing walls are coupled such that the climbing walls form an A-frame structure. The base ends of the climbing walls further comprise a pair of feet on each side of each base end such that said feet protrude from the base ends of the climbing walls substantially perpendicular to the sides of the climbing walls. Feet anchors are removably coupled to the feet on each side of the base ends of the climbing walls such that when the climbing walls are configured in the A-frame structure, the feet anchors provide a stable footing for the structure such that the portable gym structure is stabilized.

It is an object of the present invention to provide portable gym structure that is lightweight and portable.

It is a further object of the present invention to provide a portable gym structure that provides variable configurability.

It is a further object of the present invention to provide a portable gym structure that is made of lightweight polymers to allow easy set up and portability.

It is a further object of the present invention to provide a portable gym structure that is cost effective to manufacture.

It is a further object of the present invention to provide a portable gym structure where the apparatus can be extended.

DESCRIPTION OF PREFERRED EMBODIMENTS

Figure 1:
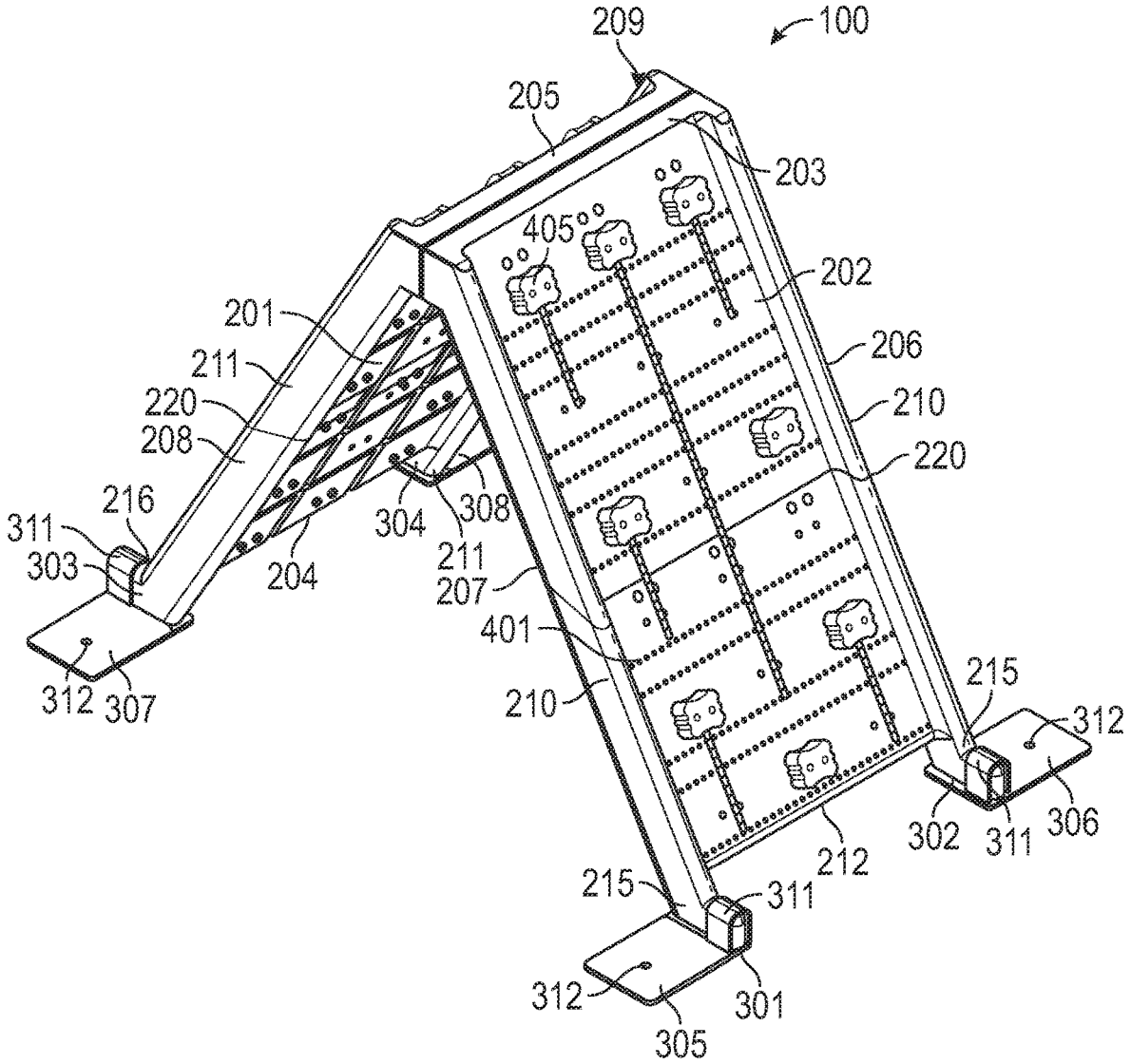
FIG. 1 shows a perspective view of the preferred embodiment of the portable gym structure.
Figure 2A:
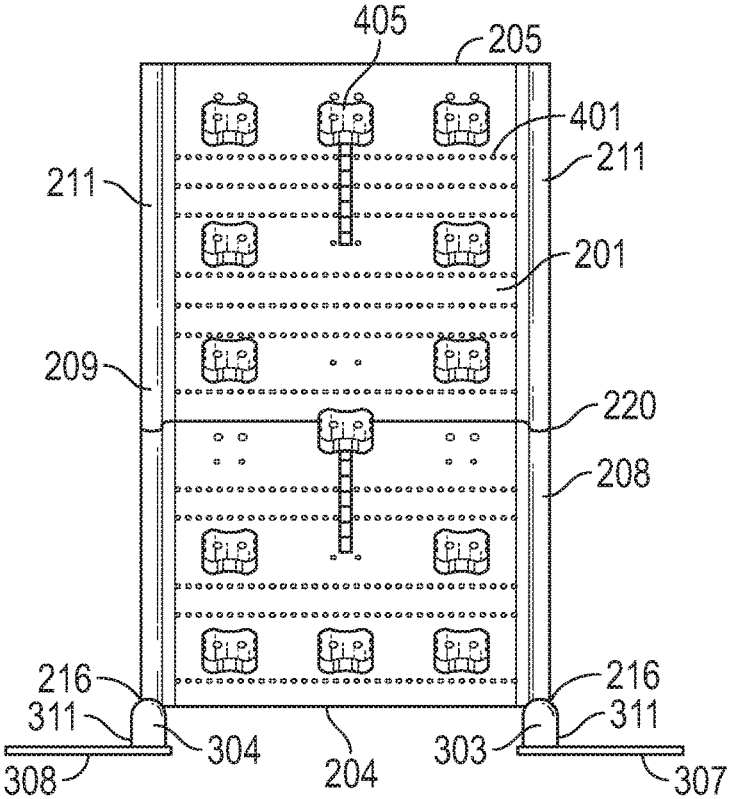
FIG. 2*a* shows a front view of the preferred embodiment of the portable gym structure with panels with holes.
Figure 2B:
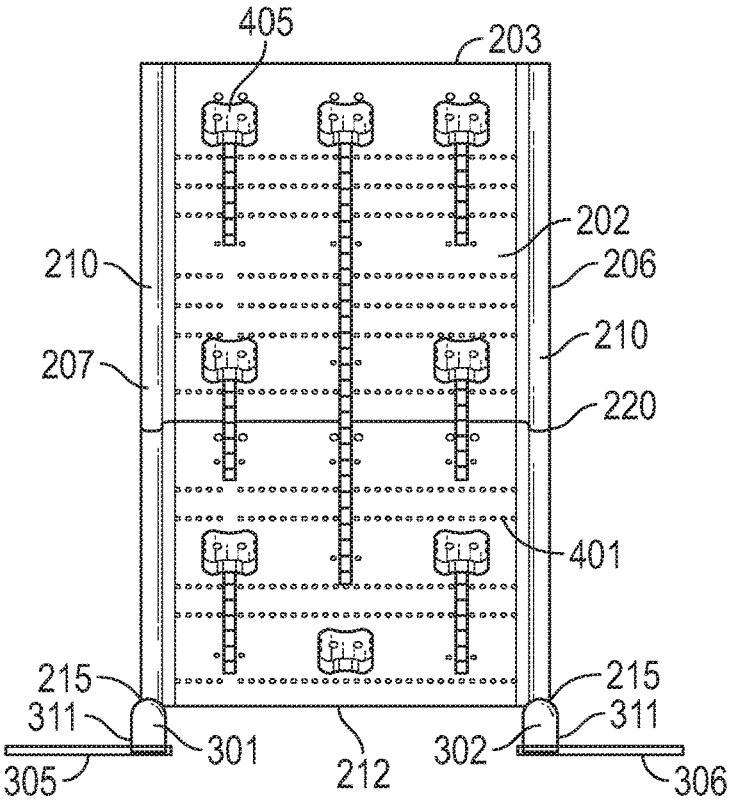
FIG. 2*b* shows a back view of the preferred embodiment of the portable gym structure with panels with holes.
Figure 3A:
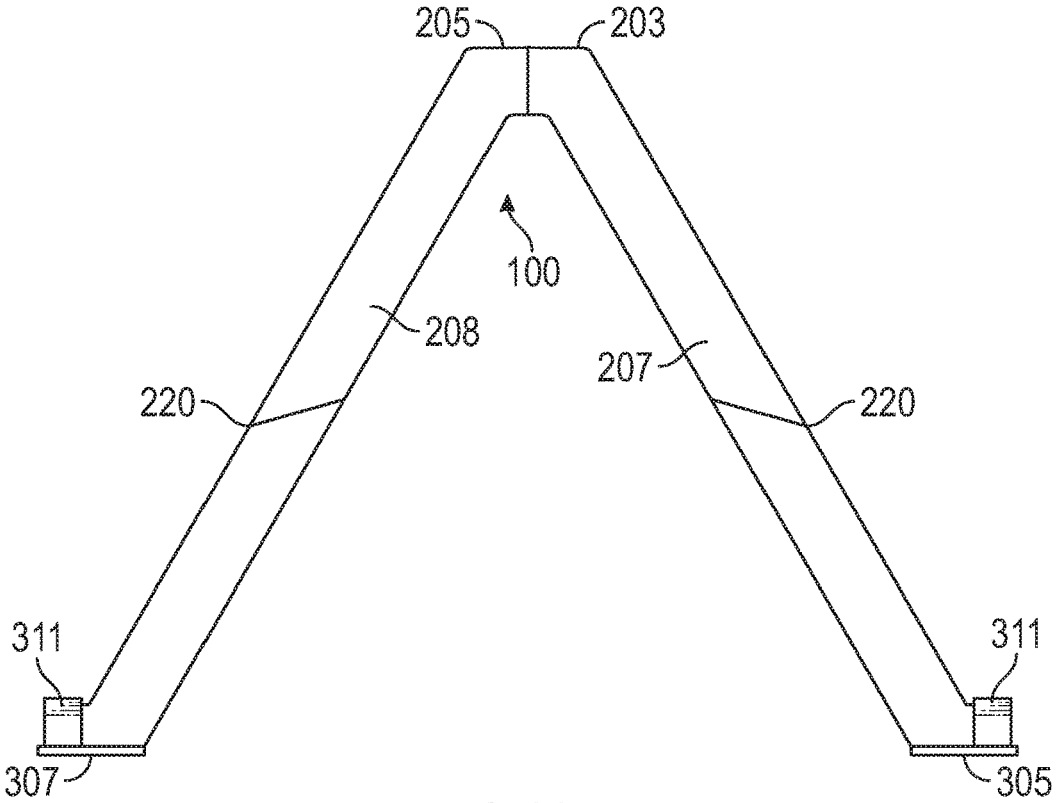
FIG. 3*a* shows a side view of the preferred embodiment of the portable gym structure in its open use mode.
Figure 3B:
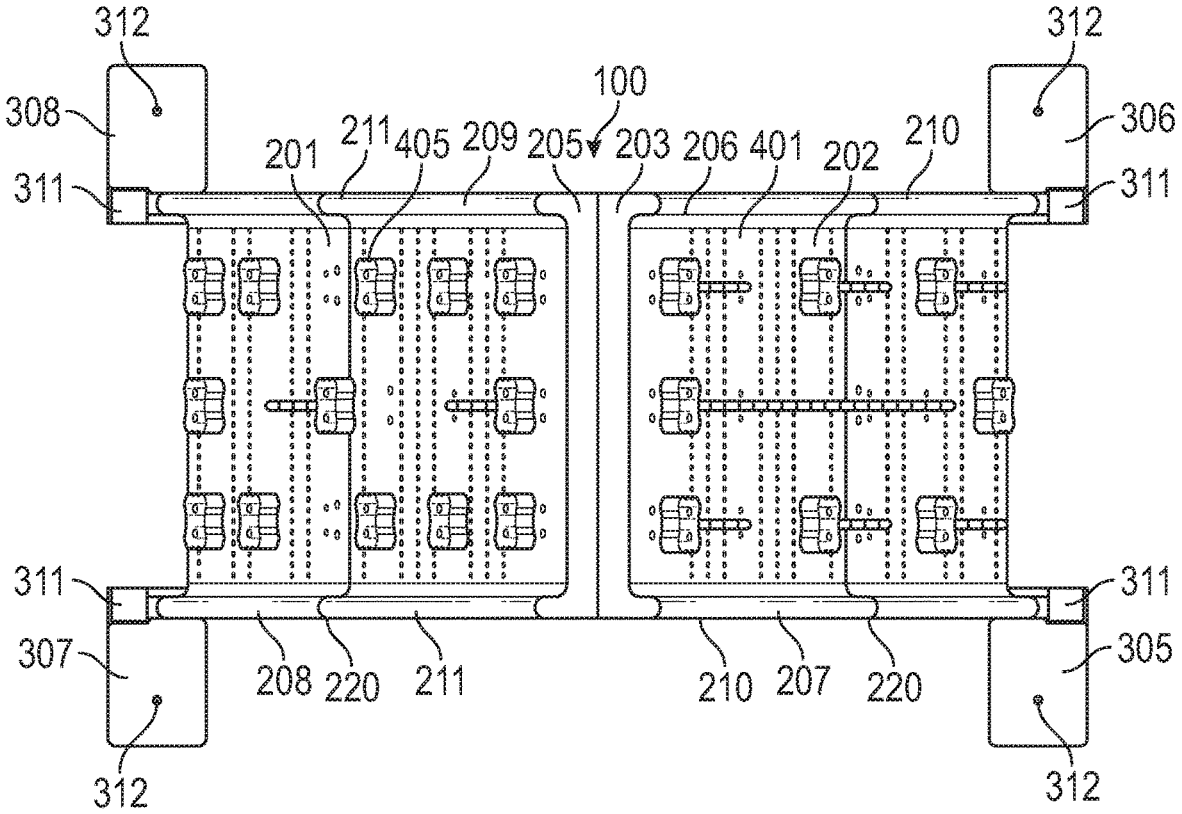
FIG. 3*b* shows a top view of the preferred embodiment of the portable gym structure in its open use mode.
Figure 4A:
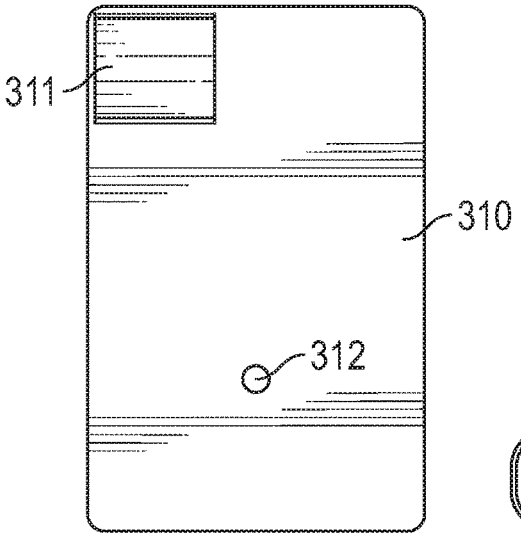
FIG. 4*a* shows a top view of one of the feet anchors of the invention.
Figure 4B:
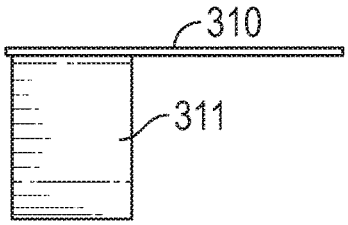
FIG. 4*b* shows a first side view of one of the feet anchors of the invention.
Figure 4C:
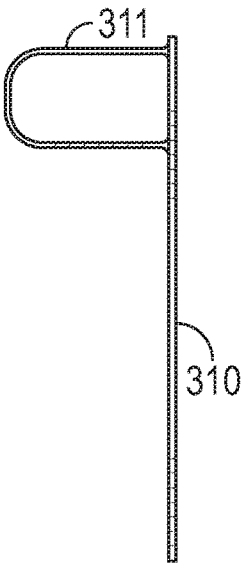
FIG. 4*c* shows a front view of one of the feet anchors of the invention.
Figure 4D:
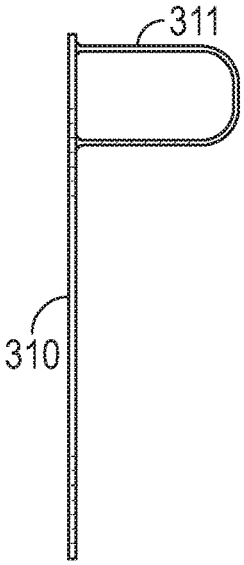
FIG. 4*d* shows a back view of one of the feet anchors of the invention.
Figure 4E:
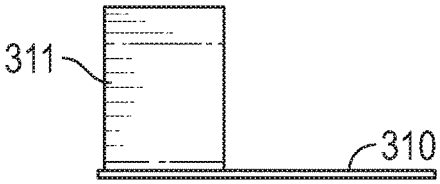
FIG. 4*e* shows a second side view of one of the feet anchors of the invention.
Figure 4F:
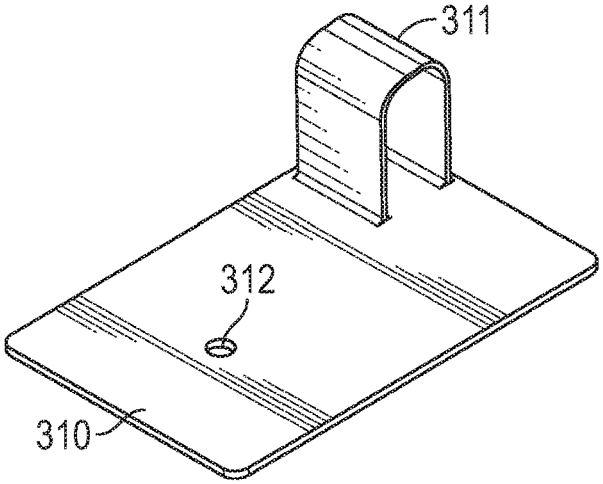
FIG. 4*f* shows a perspective view of one of the feet anchors of the invention.

The present invention relates to a portable gym structure 100. As seen in FIG. 1, the preferred embodiment of the invention includes a first climbing wall 201 and a second climbing wall 202 that are coupled together along their top ends 203 and 205, respectively. In the preferred embodiment, when the portable gym structure 100 is in the open position, as shown in FIG. 1, it forms, generally, an A-frame configuration. This A-frame configuration is achieved by coupling the climbing walls 201 and 202 such that the climbing walls 201 and 202 are movable with respect to each other and an angle defined by side edges 206, 207, 208, and 209 of the climbing walls is variable with the movement of the climbing walls 201 and 202 in relation to each other. While it is preferred that the portable gym structure 100 have an A-frame configuration, it could be of any generally triangular configuration that allows for stability of the structure including scalene and obtuse triangular configurations.

Preferably, the two climbing walls 201 and 202 are coupled along the top ends 203 and 205 with clips 605. The clips 605 have a female piece and a male piece. The male piece is attached to the top end 203 of the first climbing wall 201 and fits into the female piece on the top end 205 of the second climbing wall 202. In this embodiment, while the climbing walls 201 and 202 are detachable from each other, they do not have the ability to rotate relative to each other in varying positions of the A-frame angle. Rather, the A-frame angle is fixed based on the position of the clips 605 in the walls 201 and 202. The position and pre-set angle of the A-frame is such that maximum stability is achieved for the structure 100.

In an alternate embodiment, the climbing walls 201 and 202 of the portable gym structure 100 include top ends 203 and 205 and bottom ends 204 and 212. The top ends 203 and 205 of the climbing walls 201 and 202 are coupled together such that the two walls 201 and 202 are movable in relation to each other. In the preferred embodiment, the walls 201 and 202 are coupled together with at least one hinge connection point, not shown, and most preferably three hinge connection points. The hinge connection points are arranged in such a way that rotational movement is achieved between the climbing walls 201 and 202. This rotational movement allows for varying angles between the climbing walls 201 and 202 to allow varying difficulty levels in climbing on the portable gym structure 100 and stability of the structure 100 when it is in the open A-frame configuration.

In a further alternate embodiment, the climbing walls 201 and 202 of the portable gym structure 100 are coupled at their top ends 203 and 205 via a bolt connection. The two climbing walls 201 and 202 are bolted together such that they anchor the climbing walls 201 and 202 in the open use mode. This connection does not allow the climbing walls to rotate relative to each other.

Further, in the preferred embodiment of the invention, the climbing walls 201 and 202 each have side walls 210 and 211, respectively, that frame the climbing walls 201 and 202. These side walls 210 and 211 create a raised edge that extends out from the climbing walls 201 and 202. On each side of the bottom ends 215 and 216 of the side walls 210 and 211 are feet 301, 302, 303, and 304 as seen in FIG. 1. The feet 301, 302, 303, and 304 are located on each side of each bottom end 204 and 212 such that said feet 301, 302, 303, and 304 protrude from the bottom ends 215 and 216 of the side walls 210 and 211 substantially perpendicular to the bottom ends 215 and 216 of the side walls 210 and 211.

In the preferred embodiment, the feet 301, 302, 303, and 304 slide into feet anchors 305, 306, 307, and 308 when the portable gym structure 100 is open and in the A-frame position, shown in FIG. 1. The feet anchors 305, 306, 307, and 308 are shown in detail in FIGS. 4*a*-4*f*. As can be seen in FIGS. 4*a*-4*f*, the feet anchors 305, 306, 307, and 308 are comprised of a flat base 310 and a curved foot lock 311 that extends upward and perpendicular from the flat base 310. Preferably, the curved piece 311 is of a dimension wherein the curved foot lock 311 slides over the 301, 302, 303, and 304 such that no other securing means is required between the feet 301, 302, 303, and 304 and the feet anchors 305, 306, 307, and 308. In an alternate embodiment, the feet anchors 305, 306, 307, and 308 comprise a securing means to couple the feet anchors 305, 306, 307, and 308 to the feet 301, 302, 303, and 304. The securing means can be a pin, clip, etc.

The flat piece 310 of the feet anchors 305, 306, 307, and 308 are of a dimension wherein they provide a support base for the portable gym structure 100. The feet anchors 305, 306, 307, and 308 also, preferably, include a securing hole 312. The securing hole 312 allows the feet anchors 305, 306, 307, and 308 to have a stake driven through the hole 312 into the ground for more stability and security of the portable gym structure 100.

Figure 5:
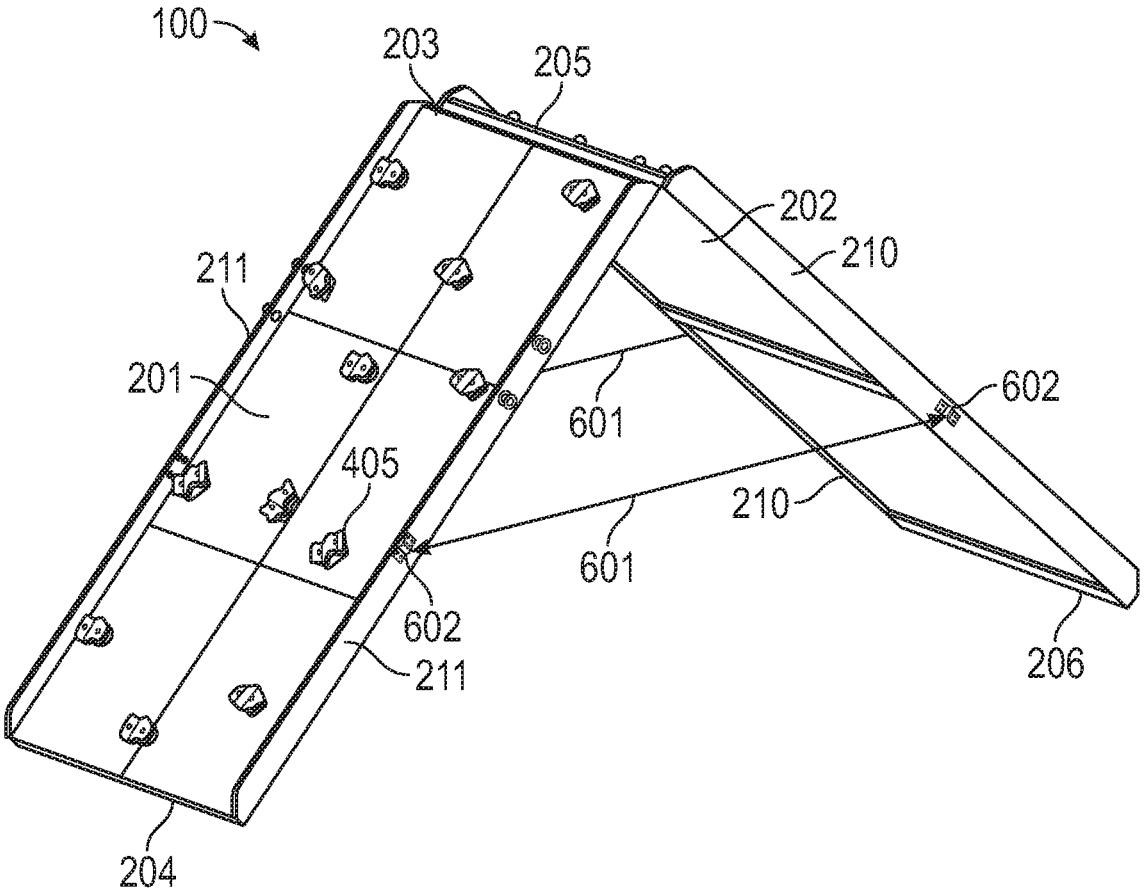
FIG. 5 shows an alternate embodiment of the invention with cable anchors.
Figure 6A:
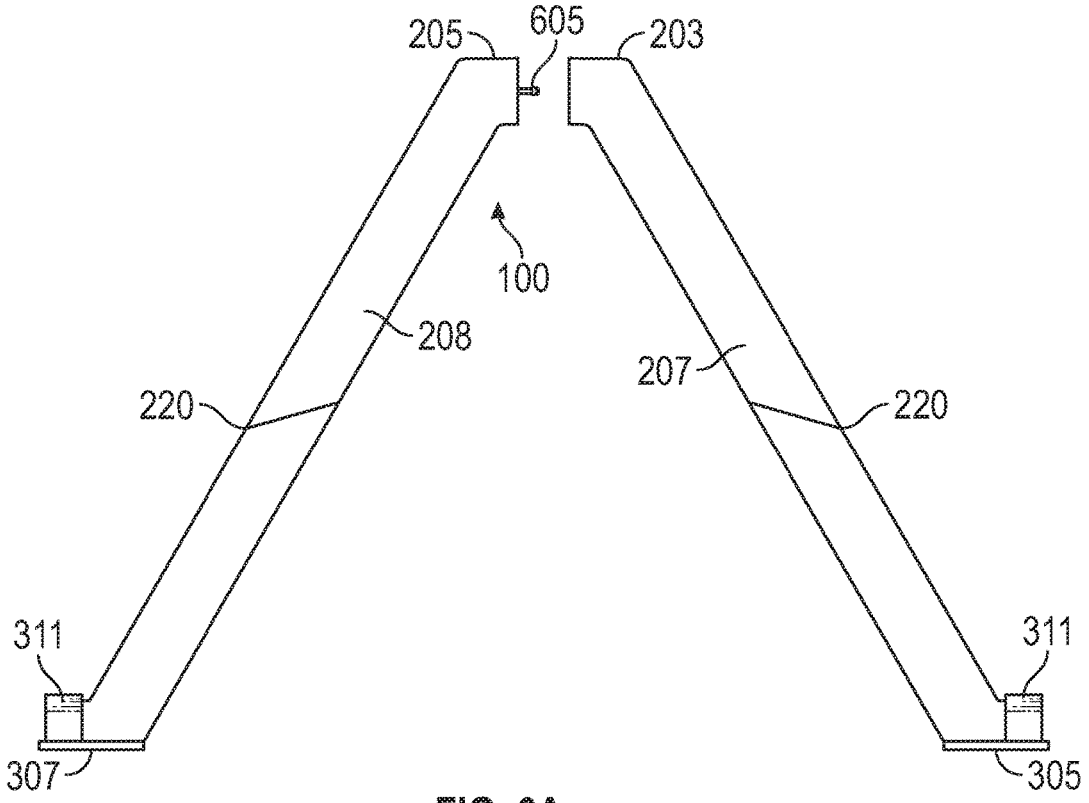
FIG. 6*a* shows a side view of the preferred embodiment of the portable gym structure in the open use mode with the first and second panels uncoupled.
Figure 6B:
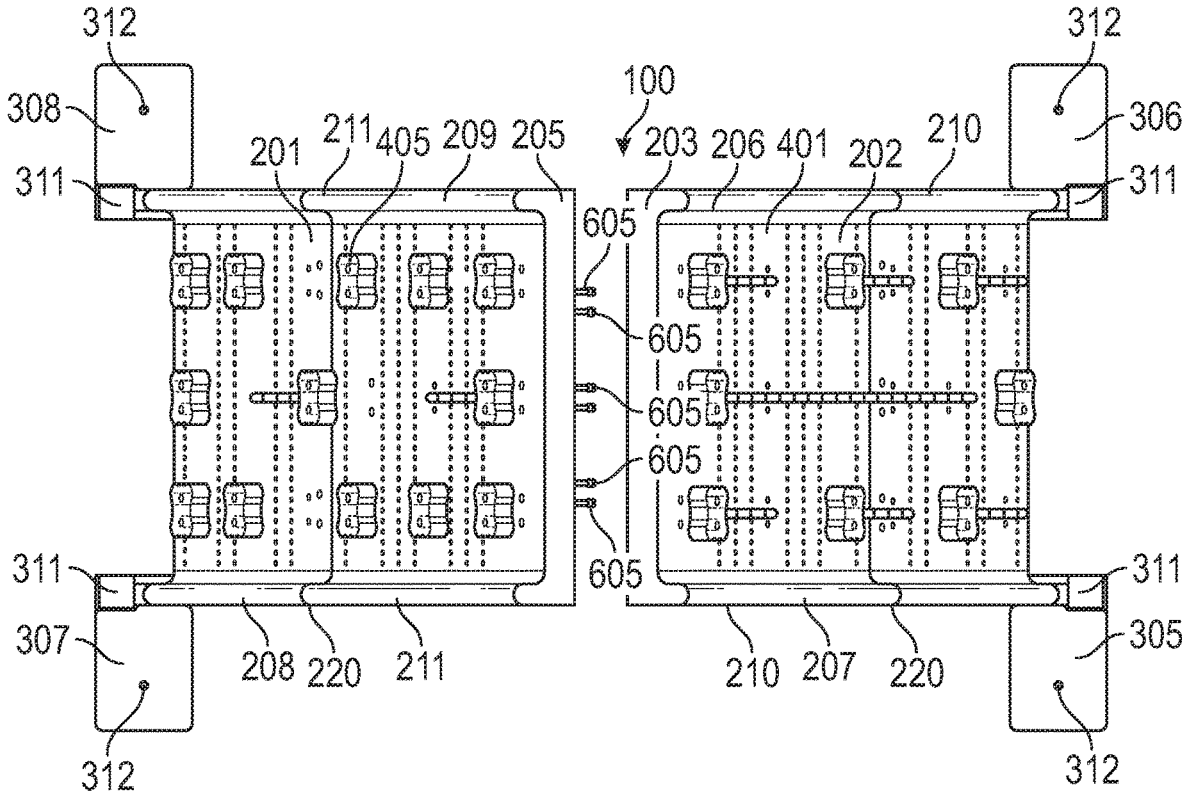
FIG. 6*b* shows a top view of the preferred embodiment of the portably gym structure in the open use mode with the first and second panels uncoupled.
Figure 7A:
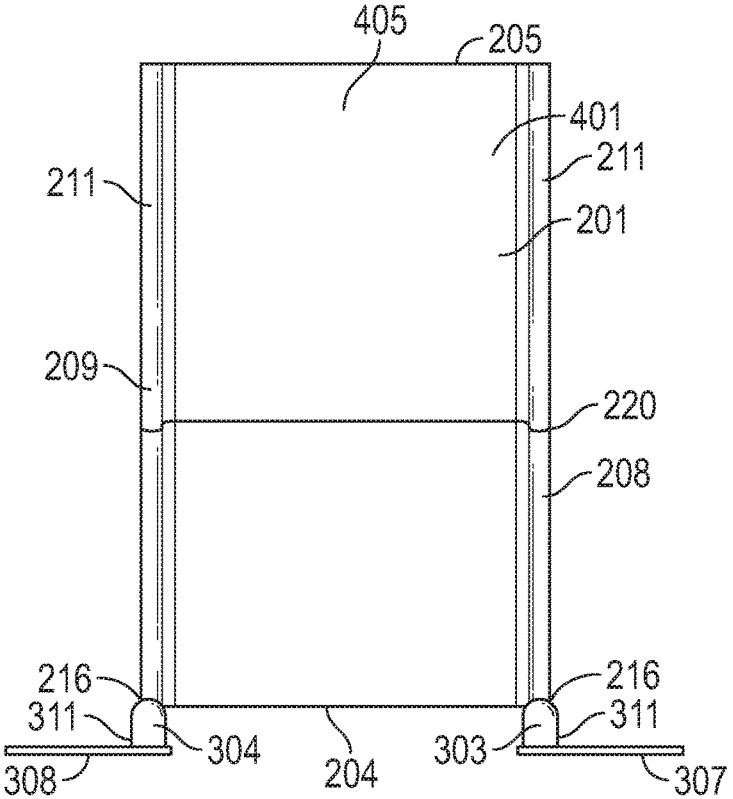
FIG. 7*a* shows front view of the preferred embodiment of the portable gym structure with panels with holes.
Figure 7B:
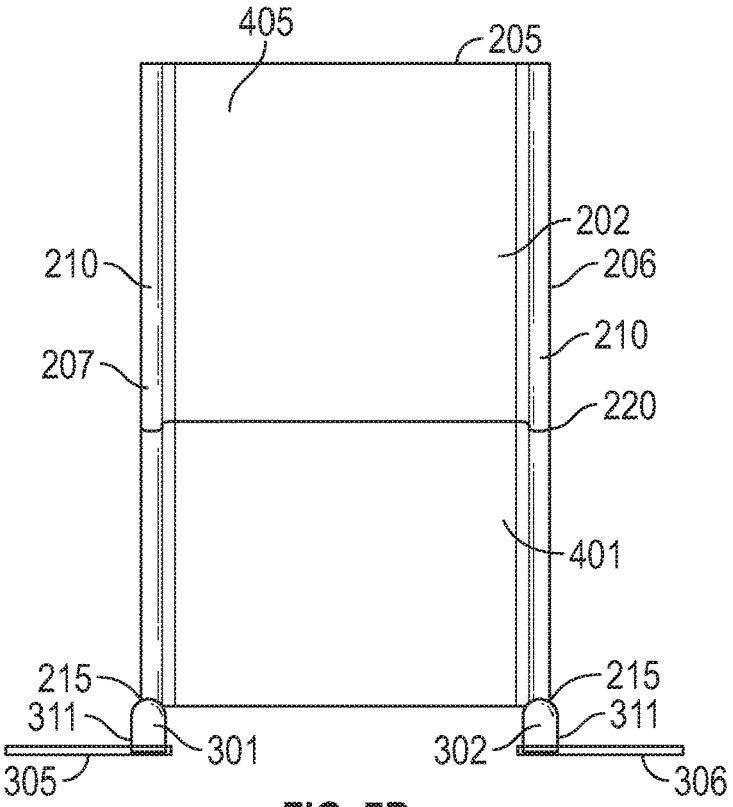
FIG. 7*b* shows a back view of the preferred embodiment of the portable gym structure with panels with holes.

In an alternate embodiment of the invention, the portable gym structure 100 is adjusted and secured using cables 601 and anchors 602 as shown in FIG. 5. Preferably, the structure includes at least two cables 601 and at least two pair of anchors 602. One each of the pair of anchors 602 is coupled to each of the climbing walls 201 and 202. The cables 601 are coupled on each of their opposite ends to the pair of anchors 602 wherein the length of the cables 601 is used to define the angle of the climbing walls 201 and 202 with respect to each other. The length of the cables 601 defines the angle of the A-frame when it is in the open position. The tension on the cables 602 as attached to the anchors 602 provide stabilization of the structure 100. Moreover, the change in the length of the cables 602 allows the user to define the angle of the structure 100 according to the need at the time. This embodiment can be used with the feet 301, 302, 303, and 304 and feet anchors 305, 306, 307, and 308 as described above.

As seen in the Figs., in one embodiment of the invention, the climbing walls 201 and 202 include a joint 220 in the middle of climbing walls 201 and 202 wherein the walls 201 and 202 are made of two separate pieces. These pieces couple together to form each of the full length climbing walls 201 and 202. This embodiment provides easier manufacture, assembly, and use. In another embodiment, the climbing walls 201 and 202 are made of one single piece with no joints. In either embodiment, the climbing walls 201 and 202 are preferably surrounded by the side walls 210 and 211 as described above.

Moreover, the climbing walls 201 and 202 are either smooth surfaces or surfaces that contain a plurality of holes 401. The smooth surface allows the user to slide down and climb up the walls 201 and 202 with no obstructions or obstacles. In contrast, the holes 401 in the walls 201 and 202 allow insertable climbing pieces 405 to be arranged along the climbing walls 201 and 202 in any configuration suitable to the user's needs. The insertable climbing pieces 405 are generally of a shape that allows the user to use as a climbing grip or an obstacle in climbing the walls 201 and 202. The climbing pieces 405 can include ropes, real or simulated rocks, or other items to make the climbing of the structure 100 more or less difficult. In the preferred embodiment, the climbing walls 201 and 202 are interchangeable to give the user of the portable gym structure 100 more options in its use.

It is preferred that the portable gym structure 100 be made of a light weight durable material. In the preferred embodiment, this material is a light weight plastic. Plastic is durable to the wear and tear placed on a portable gym structure of this type while still being light weight enough to allow easy maneuverability and portability. While plastic is preferred, any other type of light weight, durable material can be used. These materials can be a metal or other type of light weight material.

In another embodiment of the invention, more than one portable gym structure 100 can be placed end on end to create a longer structure. This can be achieved by placing the portable gym structure 100 in the position where the first and second climbing walls 201 and 202 are not put in the A-frame position, but rather stacked end on end in a flat 180° configuration. These separate gym structures 100 can be coupled together end on end and used either in a flat position on the ground or propped up against a building or structure for a more challenging climbing experience.

In a further alternate embodiment of the invention not shown, the portable gym structure 100 can be configured in a way such that there are at least three, and preferably, four climbing walls arranged such that the climbing walls form a base where the top ends of the climbing walls couple together and receive a flat piece that fits on top of the top ends of the climbing walls to form a platform. The platform is of a dimension that at least one user of the portable gym structure can stand or sit upon the platform. The formation of the climbing walls as a base provides a stable structure where the platform provides a safe and stable place for users to move around. In the configuration with three climbing walls forming the base, a triangular tripod shape is made. In the configuration with four climbing walls forming the base, a pyramid shape is made. The climbing walls would be generally constructed in the same fashion as described above.

What is claimed is:

1. A portable gym structure comprising:

first and second climbing walls, wherein each of the first and second climbing walls comprises a top end and a base end where the top end is parallel to the base end;

wherein the first and second climbing walls are coupled such that the first and second climbing walls are movable with respect to each other and an angle defined by side edges of the first and second climbing walls is variable with the movement of the first and second climbing walls in relation to each other;

wherein the top ends of the first and second climbing walls are coupled such that the first and second climbing walls form a triangular configuration;

wherein the base ends of the first and second climbing walls further comprise a pair of feet on each of the sides of each of the base ends such that said pair of feet protrude from the base ends of the first and second climbing walls perpendicular to the sides of the first and second climbing walls; and feet anchors removably coupled to the feet on each side of the base ends of the first and second climbing walls such that when the first and second climbing walls are configured in the triangular configuration, the feet anchors provide a stable footing for the portable gym structure such that the portable gym structure is stabilized, wherein the feet anchors are configured to slide over the feet on each side of the base ends of the first and second climbing walls.

2. The portable gym structure of claim 1 wherein the first and second climbing walls are panels wherein the panels are removable.

3. The portable gym structure of claim 2 wherein the panels include a plurality of holes.

4. The portable gym structure of claim 3 wherein the plurality of holes of the panels accept insertable climbing pieces such that the insertable climbing pieces are configured to be movably arranged to create a variable configuration.

5. The portable gym structure of claim 2 wherein the panels are smooth.

6. The portable gym structure of claim 1 wherein the feet anchors comprise a flat piece that is wider than a width of the pair of feet of the base ends of the first and second climbing walls and include a rounded hollow piece that is coupled to the flat piece and is perpendicular to the flat piece such that the pair of feet of the base ends fit into the rounded hollow piece.

7. The portable gym structure of claim 6 wherein the feet anchors are secured to the pair of feet of the base ends of the first and second climbing walls with a pin that fits through the feet anchors and the pair of feet of the base ends.

8. The portable gym structure of claim 1 wherein each of the first and second climbing walls further comprises a pair of opposite sidewalls that connect to an opposite side of the top end and an opposite side of the base end of the first and second climbing walls and run along the side edges of the first and second climbing walls.

9. The portable gym structure of claim 1 wherein the top ends of the first and second climbing walls are coupled with at least one hinge to form the triangular configuration.

10. A portable gym structure comprising:

first and second climbing walls, wherein each of the first and second climbing walls comprises a top end and a base end where the top end is parallel to the base end;

wherein the first and second climbing walls are coupled together;

wherein the top ends of the first and second climbing walls are coupled such that the first and second climbing walls form a triangular configuration;

wherein the base ends of the first and second climbing walls further comprise a pair of feet on each of the sides of each of the base ends such that said pair of feet protrude from the base ends of the first and second climbing walls perpendicular to the sides of the first and second climbing walls; and feet anchors removably coupled to the feet on each side of the base ends of the first and second climbing walls such that when the first and second climbing walls are configured in the triangular configuration, the feet anchors provide a stable footing for the portable gym structure such that the portable gym structure is stabilized, wherein the feet anchors are configured to slide over the feet on each side of the base ends of the first and second climbing walls.

11. The portable gym structure of claim 10 wherein the first and second climbing walls are panels wherein the panels are removable.

12. The portable gym structure of claim 11 wherein the panels include a plurality of holes.

13. The portable gym structure of claim 12 wherein the plurality of holes of the panels accept insertable climbing pieces such that the insertable climbing pieces are configured to be movably arranged to create a variable configuration.

14. The portable gym structure of claim 11 wherein the panels are smooth.

15. The portable gym structure of claim 10 wherein the feet anchors comprise a flat piece that is wider than a width of the pair of feet of the base ends of the first and second climbing walls and include a rounded hollow piece that is coupled to the flat piece and is perpendicular to the flat piece such that the pair of feet of the base ends fit into the rounded hollow piece.

16. The portable gym structure of claim 15 wherein the feet anchors are secured to the pair of feet of the base ends of the first and second climbing walls with a pin that fits through the feet anchors and the pair of feet of the base ends.

17. The portable gym structure of claim 10 wherein each of the first and second climbing walls further comprises a pair of opposite sidewalls that connect to an opposite side of the top end and an opposite side of the base end of the first and second climbing walls and run along the side edges of the first and second climbing walls.

18. The portable gym structure of claim 10 wherein the top ends of the first and second climbing walls are coupled with at least one hinge to form the triangular configuration.

19. The portable gym structure of claim 10 wherein the top ends of the first and second climbing walls are coupled with at least one clip to form the triangular configuration.

* * * * *